US006253389B1

(12) United States Patent
Scaglione

(10) Patent No.: US 6,253,389 B1
(45) Date of Patent: Jul. 3, 2001

(54) PROTECTIVE GARMENT

(76) Inventor: Charles Scaglione, 300 Spring Town Rd., New Platz, NY (US) 12561

( * ) Notice: Subject to any disclaimer, the term of this patent is extended or adjusted under 35 U.S.C. 154(b) by 0 days.

(21) Appl. No.: 09/730,962

(22) Filed: Dec. 7, 2000

(51) Int. Cl.[7] ..... A41D 13/12

(52) U.S. Cl. ..... 2/456; 2/462; 2/463; 2/464; 2/467; 2/421; 2/468

(58) Field of Search ..... 2/456, 2.5, 2.12, 2/462, 463, 464, 465, 467, 421, 468, 44, 92, 205

(56) References Cited

U.S. PATENT DOCUMENTS

| | | | | |
|---|---|---|---|---|
| 3,559,209 | | 2/1971 | Vail | 2/2.1 |
| 3,777,309 | * | 12/1973 | Yeager . | |
| 3,878,561 | * | 4/1975 | Winiecki . | |
| 4,172,294 | | 10/1979 | Harris | 2/171.3 |
| 4,455,687 | | 6/1984 | Johansson | 2/424 |
| 4,639,944 | * | 2/1987 | Lashley et al. . | |
| 4,825,476 | * | 5/1989 | Andrews . | |
| 5,005,216 | | 4/1991 | Blackburn et al. | 2/79 |
| 5,353,437 | * | 10/1994 | Field et al. . | |
| 5,465,424 | * | 11/1995 | Cudney . | |
| 5,715,541 | * | 2/1998 | Landau . | |
| 5,930,843 | * | 8/1999 | Kelly . | |
| 6,012,175 | | 1/2000 | Johnston | 2/202 |

FOREIGN PATENT DOCUMENTS

| | | | |
|---|---|---|---|
| 3901191-A1 | * | 8/1989 | (DE) . |
| WO/9705796-A1 | * | 2/1997 | (WO) . |

* cited by examiner

*Primary Examiner*—Rodney Lindsey

(57) ABSTRACT

A protective garment for preventing injury to the head, neck and torso. A helmet is rotatable mounted on a vest that includes a back section and a left front section and a right front section. The left front section are both mounted to rotate on the back section to be folded together to hold the helmet on the vest.

16 Claims, 4 Drawing Sheets

PROTECTIVE GARMENT

BACKGROUND OF THE INVENTION

1. Field of the Invention

This invention relates to protective garments and more particularly to a protective vest and head gear for use in hazardous activities, as for example, riding a motorcycle.

2. Prior Art and Objects

For sometime, it has become commonplace for persons engaged in a hazardous activity to wear protective head gear. Motorcycle operators in many jurisdictions are required to wear a helmet and construction and factory workers are required to wear protective head gear frequently referred to as "hard hats."

Absolute total protection for the entire body from all hazardous activities is not possible, at least in a manner that permits the wearer to perform the desired activity. However, what further protection can be achieved is highly desirable.

Motorcycle operation is particularly hazardous as the operator is totally exposed except possible for a helmet and possible a leather jacket and leather pants. However, motorcycles are increasing popular, frequently being operated by professionals and business executives. Unfortunately, with motorcycle operation, there is ultimately a near certainty that an accident will occur. Some of those accidents will result in limited injury but serious injury is a realty of motorcycle operation.

The body torso contains vital organs most vulnerable to injury. The head is protected by a helmet but the torso of the body including the body, chest and abdomen can receive a hard impact resulting in serious injury and even death. Even with a helmet in place, the neck also can be seriously injured unless excessive movement of the head is prevented.

Therefore, it is an object of this investigation to provide a protective garment to shield the torso from injury.

It is another object of the invention to provide a protective garment that protects the neck.

It is still another object of the invention to provide a protective garment including both a vest and helmet that can be easily worn.

It is still another object of the invention to provide a protective garment that is comparatively inexpensive to produce and of pleasant appearance.

These and other objects and advantages of the present invention will become apparent to those of ordinary skill in the art as the description thereof proceeds.

SUMMARY OF THE INVENTION

A protective garment for the head neck and torso of the body of a person wearing the protective garment which includes a helmet and a vest which vest has a back section, a left front section and a right section. The left front section and the right front section are mounted to rotate on the back section to bring the left front section and the right front section together. A fastening means secures the left front section and the right front section together. The helmet has a lower edge and the vest has an upper edge. A means is provided at the lower edge of the helmet and at the upper edge of the vest to secure the helmet to the vest and to permit the helmet to rotate on the vest.

DETAILED DESCRIPTION OF THE DRAWINGS

DETAILED DESCRIPTION OF THE INVENTION

Figure 1:
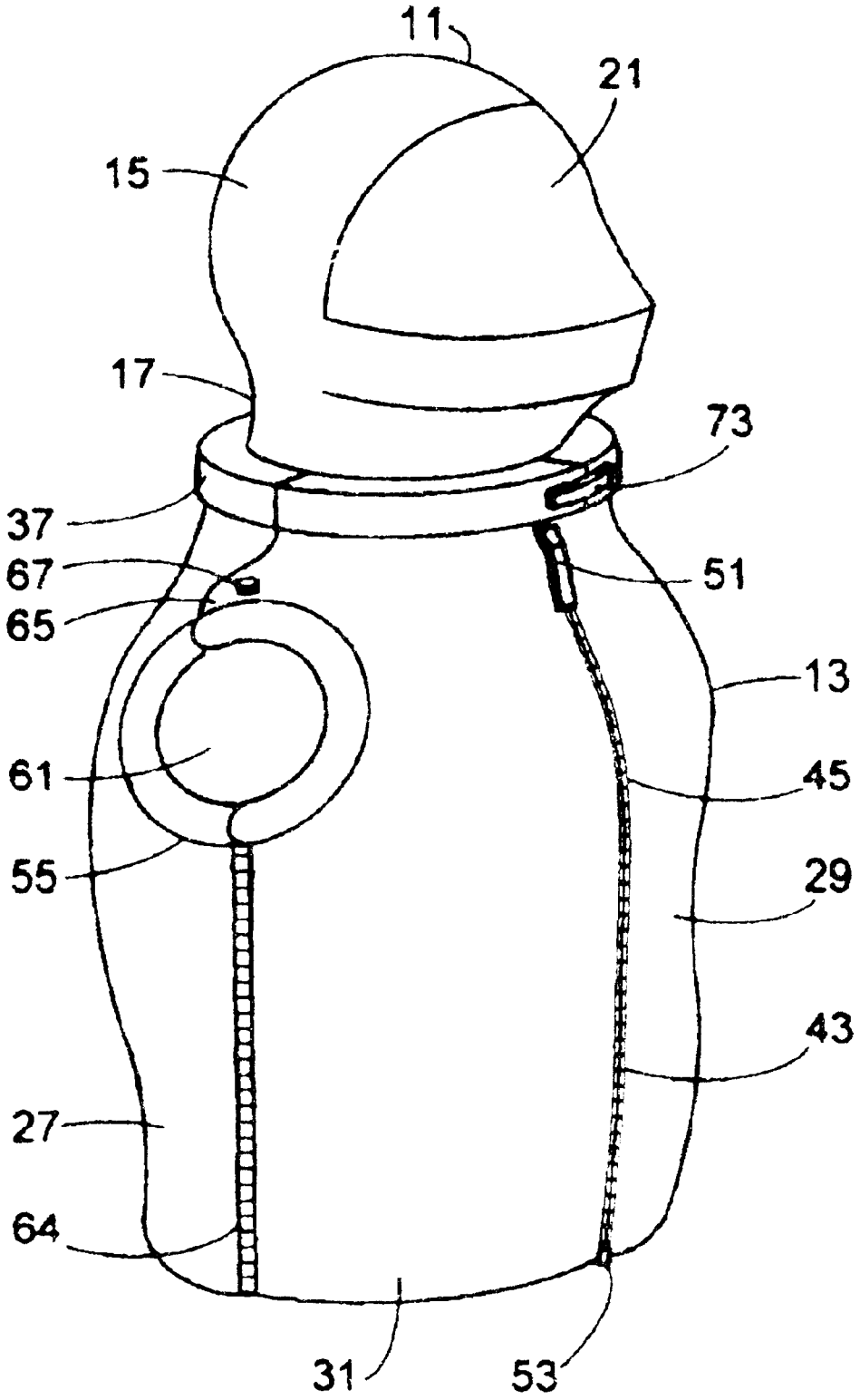
FIG. 1 is a pictorial view of the protective garment in a closed position as worn.

As best seen in FIG. 1, the protective garment includes a helmet 11 and a vest 13. The helmet 11 is similar to known helmets now worn by motorcycles operators and has a head section 15 and neck section 17 which fits about the neck. The neck section 17 has a lower edge 19 which is also the lower edge 19 of the helmet 11. The lower edge 19 of the helmet 11 is essentially circular. A visor 21 is located in the front of the helmet 11 in the head section 15 to permit the obviously essential visibility.

Figure 4:
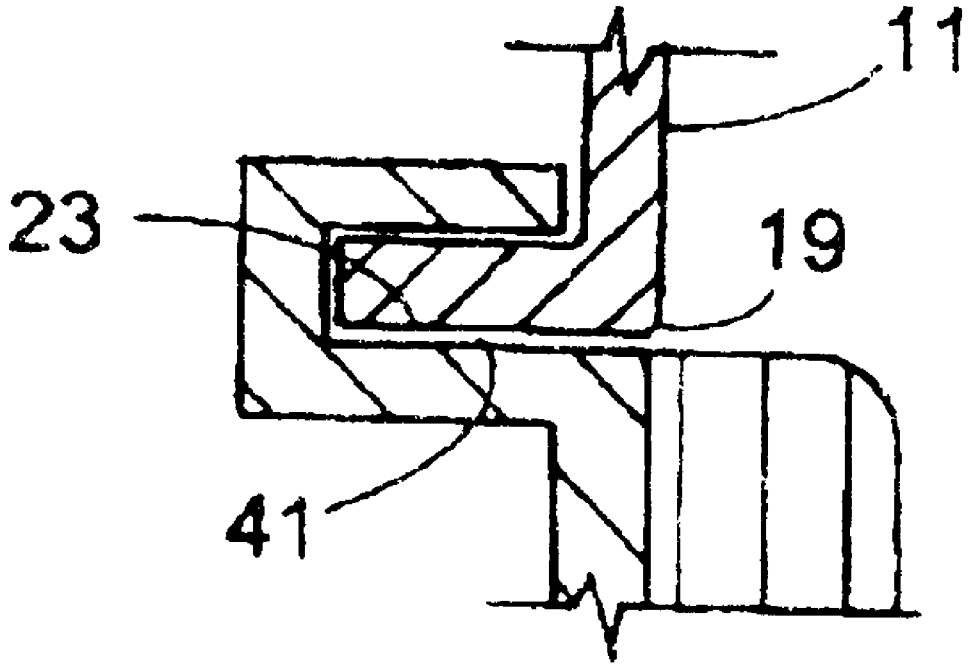
FIG. 4 is a detail of the flange at the lower edge of the helmet located in the indentation of the collar on the vest.

A feature of the helmet 11 which is distinctive from helmets currently known, is a flange 23 at the lower edge 19 of the helmet 11. This flange 23, best seen in FIG. 4, is a protrusion extending outwardly from the helmet 11 generally at right angles to the vertical axis 25 of the helmet 11 as worn. The flange 23 also extends continuously about the entire lower edge 19 of the helmet 11 and thus is essentially circular as is the lower edge 19.

Figure 2:
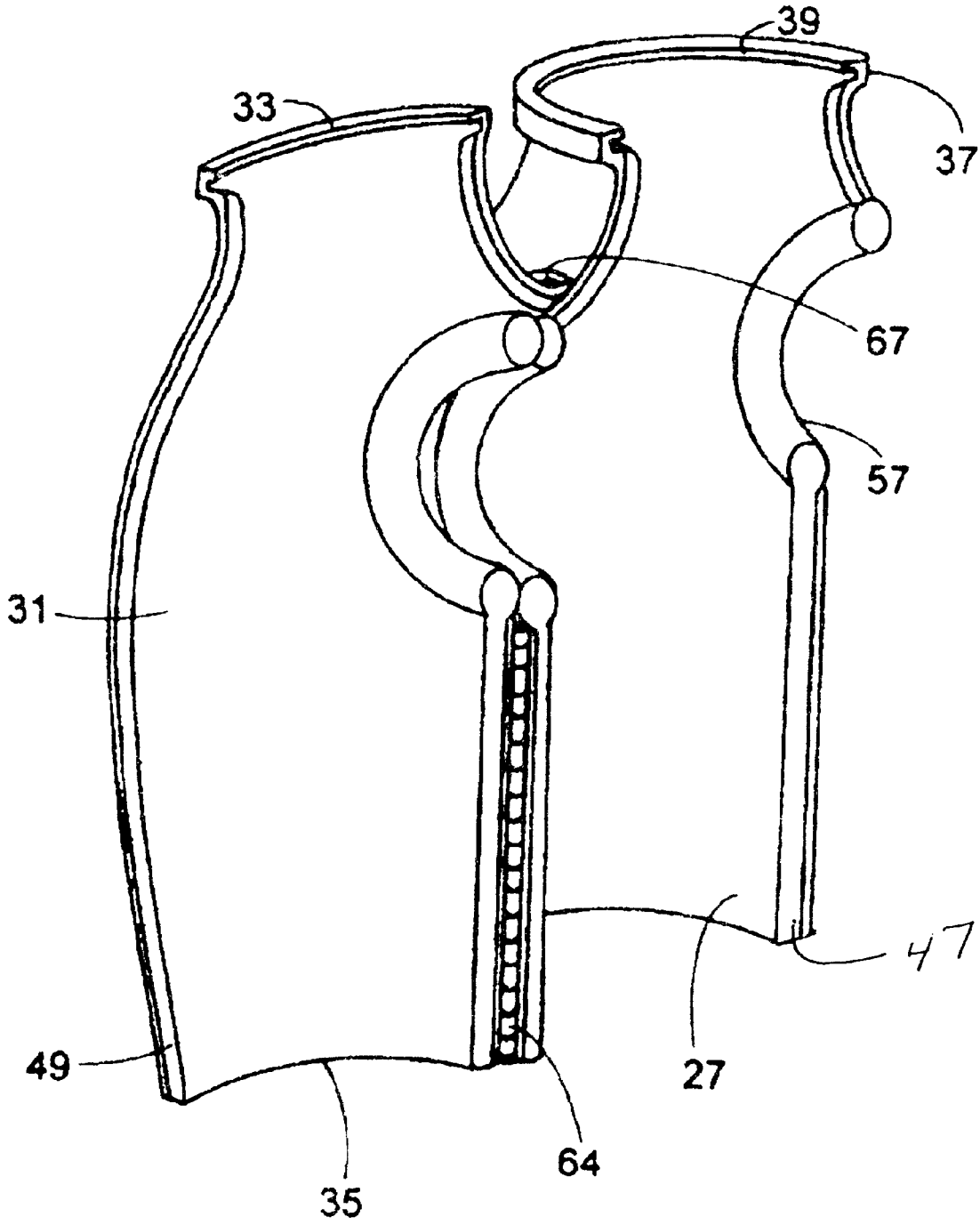
FIG. 2 is a pictorial view of a portion of the vest showing only the back section and the right front section with the right front section rotated back from the closed position.
Figure 3:
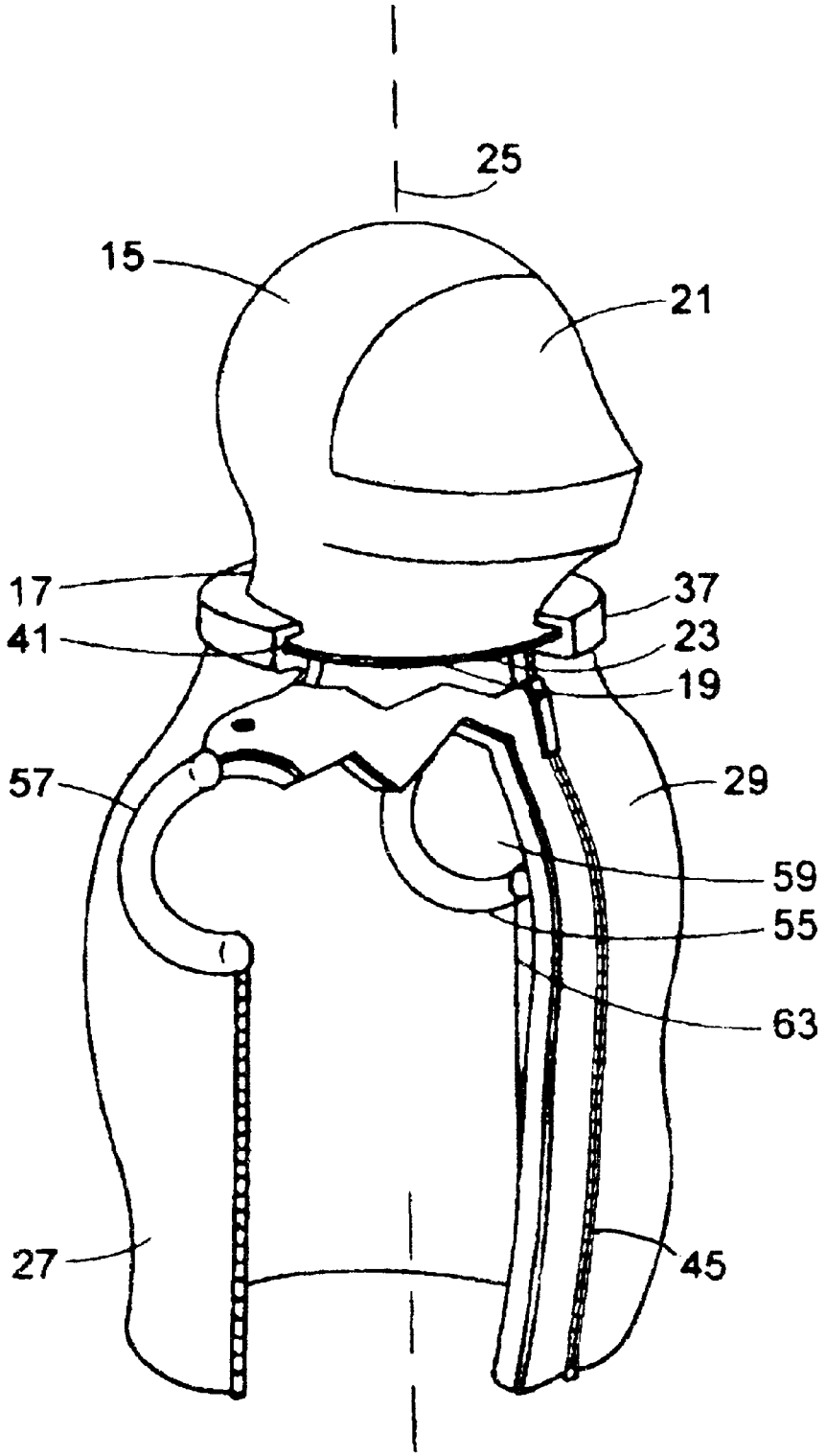
FIG. 3 is a pictorial view of the protective garment with the helmet in place with the left front section closed and the right front section removed.

The vest 13 has three major sections, as seen in FIG. 1 and in FIG. 2, namely a back section 27 and a left front section 29 and a right front section 31. The terms "left" and "right" are consistent with the left and right sides and arms of one wearing the protective garment. The right front section 31 and the left front section 29 are generally each a quarter of the vest 13 and are both located on the front of the wearer to cover the chest and abdomen of the wearer. The back section 27 covers the back and represents approximately one-half of the vest 11. The vest 11 has an upper edge 33 which is connected to the helmet 11 about the neck of the wearer and a lower edge 35 which fits about the waist of the wearer.

At the upper edge 33 of the vest 11, a collar 37 is formed as part of the vest 13 and is part of the back section 27 and the left front section 29 and the right front section 31. The collar 37 is circular when the left front section 29 and the right front section 31 are secured to one another and the collar 37 extends about all the way around the vest 13. The collar 37 protrudes outside the upper edge 33 of the vest 13 and has an internal surface 39 with an indentation 41 on the internal surface 39. The indentation 41 is horizontal and is adapted to receive the flange 23. The flange 23, when in the indentation 41, is permitted to slide. In this way, with the vest 13 closed and with the collar 37 completely encasing the flange 23, the helmet 13 rotates with the turning of the head of the wearer.

The right front section 31 and the left front section 29, when folded together, come in very close proximity to one another and are joined in the center of the front of the protective garment by a fastener 43, preferably a slide fastener having two sets of interlocking teeth 45. The left front section 29 has a left center edge 47 and the right front section 31 has right center edge 49. When the vest 13 is closed, the left center edge 47 and the right center edge 49 are in close proximity to one another and face one another. The fastener 43 is mounted on both the left center edge 47 and the right center edge 49 and has an upper end 51 and a lower end 53. In order to engage the fastener 43, the left front section 29 and the right front section 31 must be folded together with the left center edge 47 and the right center edge 49 facing one another as just explained. The fastener 43 permits complete release between the left front section 29 and the right front section 31 when opened.

In both the left front section 29 and the right front section 31, toward the upper edge 33 of the vest 13, a semicircular opening 55 is formed. In the back section 29, two semicircular openings 57 are formed, one of which matches the semicircular opening 55 in the left front section 29 to form a left opening 59 and the other semicircular opening 57 in the back section 29 mates with the semicircular opening 55 in the right front to section 31 to form a right opening 61. The left opening 59 and the right opening 61 are generally aligned with one another and are generally equally spaced from the upper edge 33 of the vest 13.

A left hinge 63 extends from the right opening 61 to the lower edge 35 of the vest 13 and a right hinge 64 extends from the left opening 59 to the lower edge 35 of the vest 13. Both the left front section 29 and the right front section 31 form a slight overlap 65 over the back section 27 above the left opening 59 and the right opening 61 to the upper edge 33 of the vest 13. Directly above the left hinge 63 and the right hinge 64 a pin 67 joins the left front section 29 and the back section 27 and joins the right front section 31 and the back section 27. Each pin 67 is aligned with its respective hinge 63,64. The left front section 29 rotates on the pin 67 and the left hinge 63. The right front section 31 rotates on its respective pin 67 and the right hinge 64.

A lock 73 of any suitable design is mounted on the collar 37 across the left center edge 47 and the right center edge 49. The lock 73 serves to assure that the vest 13 will not open on impact thus also assuring that the helmet 11 will remain secured to the vest 13.

To wear the protective garment, the wearer places the vest 13 with the left front section 29 and the right front section 31 open and with the part of the left opening 59 and right opening 61 held on the arms, the helmet 11 is placed on the head and the flange 23 is fitted into the indentation 41 on the back section 27. The right front section 31 and left front section 29 are then folded together with the flange 23 sliding into the indentation 41 in the collar 37 of the left front section 29 and the right front section 31. The fastener 43 and the lock 73 are then both secured.

Thus, while a preferred embodiment of the invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A protective garment for the head, neck and torso of the body of a person wearing the protective garment, such protective garment comprising:

a helmet having a head section with a visor and a neck section;

a vest having an upper edge and a lower edge, the vest including a back section, a left front section and a right front section, the left front section and the right front section being mounted to rotate on the back section to bring the left front section and the right front section together;

fastening means to secure the left front section and the right front section together; and means located at a lower edge of the helmet and at the upper edge of the vest to secure the helmet to the vest and to permit the helmet to rotate on the vest.

2. A protective garment according to claim 1 wherein the means to secure the helmet to the vest to rotate on the vest includes a flange at the lower edge of the helmet and an indentation at the upper edge of the vest, the flange being located in the indentation with the left front section and the right front section being together.

3. A protective garment according to claim 1 wherein the neck section is reduced is size from the head section.

4. A protective garment according to claim 1 wherein the left front section and the right front section are substantially the same size and are approximately one half the size of the back section.

5. A protective garment according to claim 1 wherein the fastening means is continuous and interlocking.

6. A protective garment according to claim 1 wherein the back section and the left section have a left opening located toward the upper edge and the back section and the right front section have a right opening located substantially in the same relationship to the upper edge as the left opening.

7. A protective garment for the head, neck and torso of the body of a person wearing the protective garment, such protective garment comprising:

a helmet including:

a head section which is adapted to fit about the head, the head section further including a visor to provide visibility; and a neck section which is reduced in size from the head portion and having a lower edge, the lower edge being generally circular;

a vest having an upper edge and a lower edge, the vest including:

a back section, a left front section and a right front section, the left front section and the right front section being both mounted to rotate on the back section and the left front section and the right front section being adapted to fold toward one another so as to be in close proximity to one another;

a fastening means to secure the left front section and the right front section together;

a collar section at the upper edge of the back section and the left and right front sections, the collar section being substantially circular when the left and right front sections are folded toward one another and are in close proximity to one another, the lower edge of the helmet being mounted to rotate in the collar; and the back section and the left front section having a left opening located toward the upper edge and the back section and the right front section having a right opening located substantially in the same relationship to the upper edge as is the left opening.

8. A protective garment according to claim 7 wherein the back section of the vest is approximately one-half of the vest and the left front section and the right front section are each approximately one-quarter of the vest.

9. A protective garment according to claim 7 wherein the left front section is mounted to rotate on the back section by means of a left hinge and the right front section is mounted to rotate on the back section by means of a right hinge.

10. A protective garment according to claim 7 wherein the left front section is mounted to rotate on the back section by means of a left hinge and the right front section is mounted to rotate on the back section by means of a right hinge, the left hinge extending generally from the left opening to the lower edge of the vest and the right hinge extending generally from the right opening to the lower edge of the vest.

11. A protective garment according to claim 7 wherein the fastening means is continuous and interlocking.

12. A protective garment according to claim 7 wherein the left front section slightly overlaps the back section between the left opening and the upper edge of the vest and the right front section slightly overlaps the back section between the right opening and the upper edge.

13. A protective garment according to claim 7 wherein the left front section slightly overlaps the back section between the left opening and the upper edge of the vest and the right front section slightly overlaps the back section between the right opening and the upper edge; and a left pin is located through the left front section and the back section to permit the left section to rotate on the left pin and a right pin is located through the right front section and the back section to permit the right front section to rotate on the right pin, the left front pin being aligned with the left hinge and the right pin being aligned with the right hinge.

14. A protective garment according to claim 7 further including a left cushion encircling the left opening and a right cushion encircling the right opening.

15. A protective garment for the head, neck and torso of the body of a person wearing the protective garment, such protective garment comprising:

a helmet having a vertical axis including:

a head section which is adapted to fit about the head, the head section further including a visor to provide visibility, and a neck section which is reduced in size from the head portion and having a lower edge, the lower edge being generally circular and including a flange, the flange extending about the lower edge generally at right angles to the vertical axis of the helmet, the flange being substantially circular:

a vest having an upper edge and a lower edge, the vest including:

a back section, a left front section and a right front section, the back section being approximately one half of the vest and the left front section and the right front section each being approximately one-quarter of the vest, the left front section being connected to the back section by a left hinge so as to be rotated on the back section and the right front section being connected to the back section by a right hinge and the left front section and the right front section being adapted to fold toward one another so as to be in close proximity to one another;

a fastening means to secure the left front section and the right front section together, the fastening means being continuous and interlocking;

a collar at the upper edge of the back section and the left and right front sections, the collar being substantially circular when the left and right front sections are folded toward one another and are in close proximity to one another, the collar having an internal surface with an indentation, the indentation being generally at right angles to the vertical axis of the helmet and being adapted to hold the flange while permitting the flange to turn within the indentation;

the back section and the left front section having a left opening located toward the upper edge and the back section and the right front section having a right opening located substantially in the same relationship to the upper edge as is the left opening, the left hinge being located between the left opening and the lower edge and the right hinge being located between the right opening and the lower edge, the left front section slightly overlapping the back section between the left opening and the upper edge and the right front section slightly overlapping the back section between the right opening and the upper edge; and a left pin through the left front section and the back section to permit the left front section to rotate on the left pin and a right pin through the right front section and the back section to permit the right front section to rotate on the right pin, the left pin being aligned with the left hinge and the right pin being aligned with the right hinge.

16. A protective garment according to claim 15 further including a left cushion encircling the left opening and a right cushion encircling the right opening.

* * * * *